US008142572B2

(12) United States Patent
Shirai et al.

(10) Patent No.: US 8,142,572 B2
(45) Date of Patent: Mar. 27, 2012

(54) LAVATORY PAN WASHING APPARATUS AND WASHING METHOD

(75) Inventors: Yasuhiro Shirai, Tokoname (JP); Osamu Matsumoto, Tokoname (JP); Aki Shirako, Tokoname (JP); Haruo Yamasaki, Tokoname (JP); Kenichi Ito, Tokoname (JP); Yasuhiro Kondo, Tokoname (JP); Ken Hirabayashi, Tokoname (JP); Atsushi Ito, Kariya (JP)

(73) Assignee: LIXIL Corporation, Tokyo (JP)

( * ) Notice: Subject to any disclaimer, the term of this patent is extended or adjusted under 35 U.S.C. 154(b) by 691 days.

(21) Appl. No.: 11/997,327

(22) PCT Filed: Jul. 26, 2006

(86) PCT No.: PCT/JP2006/314791

§ 371 (c)(1),
(2), (4) Date: Jan. 30, 2008

(87) PCT Pub. No.: WO2007/015403

PCT Pub. Date: Feb. 8, 2007

(65) Prior Publication Data

US 2010/0212696 A1 Aug. 26, 2010

(30) Foreign Application Priority Data

Aug. 1, 2005 (JP) ..... 2005-223027

(51) Int. Cl.
*B08B 9/00* (2006.01)

(52) U.S. Cl. ..... 134/22.1; 4/300; 4/316; 4/321; 4/325; 4/354; 134/42; 134/56 R; 134/166 R; 134/192

(58) Field of Classification Search ..... 134/166 R, 134/169 R, 171, 184, 186, 192, 21, 42, 56 R; 4/300, 316, 321, 325, 354, 435
See application file for complete search history.

(56) References Cited

U.S. PATENT DOCUMENTS 2,126,448 A * 8/1938 Campus ..... 4/300

(Continued)

FOREIGN PATENT DOCUMENTS

EP 1 832 688 A1 9/2007

(Continued)

OTHER PUBLICATIONS

Machine translation of JP-2006061262A; Kosugi, I., Feb. 28, 2002.*

(Continued)

*Primary Examiner* — Michael Barr
*Assistant Examiner* — Benjamin Osterhout
(74) *Attorney, Agent, or Firm* — Oblon, Spivak, McClelland, Maier & Neustadt, L.L.P.

(57) ABSTRACT

A lavatory pan washing apparatus includes a water supply unit supplying washing water into a rim so that a whirling flow is formed in a lavatory bowl, an air inlet pipe connected to a water discharge channel continuing to the downstream side of a water sealing portion of a pan, an air sucking unit sucking air through the pipe from the channel, and a control unit configured to activate the water supply unit at a time of washing of the pan so that the washing water is supplied into the water sealing portion. The control unit is configured to start activation of the air sucking unit after rise of a water level in the lavatory bowl, so that air is sucked through the pipe from the channel. The control unit is configured to deactivate the water supply unit after air has flowed through the air inlet pipe into the channel.

10 Claims, 8 Drawing Sheets

U.S. PATENT DOCUMENTS

| | | | | | |
|---|---|---|---|---|---|
| 3,995,328 | A | * | 12/1976 | Carolan et al. | 4/316 |
| 4,233,698 | A | * | 11/1980 | Martin | 4/354 |
| 4,928,326 | A | * | 5/1990 | Olin et al. | 4/300 |
| 5,214,807 | A | * | 6/1993 | Terve | 4/321 |
| 5,245,711 | A | * | 9/1993 | Oldfelt et al. | 4/435 |
| 5,421,040 | A | * | 6/1995 | Oldfelt | 4/435 |
| 5,539,938 | A | * | 7/1996 | Tubbs | 4/325 |

FOREIGN PATENT DOCUMENTS

| | | | |
|---|---|---|---|
| JP | 5 14282 | | 2/1993 |
| JP | 7 54388 | | 2/1995 |
| JP | 10-096255 | | 4/1998 |
| JP | 2002-061262 | | 2/2002 |
| JP | 2002 257099 | | 9/2002 |
| WO | 02/14148 | A1 | 2/2002 |
| WO | 2007/072779 | A1 | 6/2007 |

OTHER PUBLICATIONS

Machine Translation of JP 2002061262 to Kusugi, Feb. 2002.*

* cited by examiner

LAVATORY PAN WASHING APPARATUS AND WASHING METHOD

TECHNICAL FIELD

The present invention relates to a lavatory pan washing apparatus and a lavatory pan washing method.

BACKGROUND ART

In the related art, a lavatory pan washing apparatus in which washing water is supplied into a water sealing portion composed of a lower portion of a lavatory bowl and a rising conduit continuing thereto and air is sucked from a water discharge channel continuing to a downstream side of the water sealing portion for causing siphon action in a lavatory pan is proposed (Japanese Patent Application Publication No. JP-A-H10-96255). The lavatory pan washing apparatus as an example in the aforementioned Publication NO. JP-A-H10-96255 includes an ejector (referred to as "aspirator" in the aforementioned Publication No. JP-A-H10-96255) provided at a midway of a water supply pipe for discharging water to a rim water channel of the lavatory pan and a switch valve provided on a water supply pipe on the downstream side of the ejector. A pipe continuing to the water discharge channel is connected to an inlet port of the ejector, and the switch valve is also positioned at a midway of the pipe.

When washing the lavatory pan by the lavatory pan washing apparatus, supply of washing water to the rim water channel is started first while supplying washing water to the ejector. Then, the switch valve is switched right after to communicate the inlet port of the ejector to the water discharge channel. Accordingly, the ejector sucks air from the water discharge channel by a negative pressure generated at the inlet port. Therefore, the siphon action takes place.

A laboratory pan washing apparatus disclosed in Japanese Patent Application Publication No. JP-A-2002-61262 is also proposed. The lavatory pan washing apparatus as an example in the aforementioned Publication No. JP-A-2002-61262 includes a water supply pipe for supplying washing water branched into a pipe for discharging water to a rim water channel and a pipe to be connected to the ejector (referred to as "jet pump" in the aforementioned Publication No. JP-A-2002-61262), and an air inlet port of the ejector is connected to a water discharge channel.

When washing the lavatory pan by this lavatory pan washing apparatus, supply of washing water to the ejector is started at the same time as start of supply of washing water to the rim water channel. Accordingly, the ejector sucks air from the water discharge channel by a negative pressure generated at an inlet port. Therefore, the siphon action takes place.

However, in the lavatory pan washing apparatuses disclosed in the aforementioned Japanese patent application publications, air is sucked from the water discharge channel to cause the siphon action immediately after or simultaneously with starting of supply of washing water to the rim water channel of the lavatory pan. In other words, in these lavatory pan washing apparatuses, air in the water discharge channel is sucked to cause the siphon action in a state in which very little amount of washing water is supplied to the lavatory bowl of the lavatory pan or in a state in which no washing water is supplied thereto. In this case, since the potential energy and the kinetic energy of washing water stored in the lavatory bowl are small, water force to the water discharge channel is weak, and hence sewage or the like in the lavatory bowl cannot be discharged sufficiently. When the amount of supply of washing water from the rim water channel to the lavatory bowl is small, the sewage or paper in the lavatory bowl cannot be dashed with the washing water, and hence sufficient discharge of the sewage or the like in the lavatory bowl cannot be achieved from this point as well.

On the other hand, in this lavatory pan washing apparatus, increasing the force of washing water supplied from the rim water channel to the lavatory bowl is considered for achieving sufficient discharge of the sewage in the lavatory bowl. However, in order to do so, it is necessary to increase the amount of supply of washing water, which contradicts the idea of water saving.

SUMMARY

In view of such circumstances, it is an object of the present invention to achieve a lavatory pan washing apparatus and a lavatory pan washing method in which higher discharging capability and higher water-saving effect are both realized.

The present invention provides a lavatory pan washing apparatus comprising water supply means that supplies washing water into a rim in a one-way supply manner so that a whirling flow is formed in a lavatory bowl of a lavatory pan, the rim being provided along an upper inner periphery of the lavatory bowl; an air inlet pipe connected to a water discharge channel continuing to the downstream side of a water sealing portion of the lavatory pan; air sucking means that sucks air through the air inlet pipe from the water discharge channel; and control means that is configured to activate the water supply means at a time of washing of the lavatory pan so that the washing water is supplied through the lavatory bowl into the water sealing portion, the control means being further configured to start activation of the air sucking means after a water level has risen so that air is sucked through the air inlet pipe from the water discharge channel, the control means being further configured to deactivate the water supply means after air has flowed through the air inlet pipe into the water discharge channel.

According to the above-described lavatory pan washing apparatus, when starting suction of air from the water discharge channel by the air sucking means, the water level in the lavatory bowl is higher than the sealing water level ($\Delta H$). The potential energy obtained by the head difference which corresponds to $\Delta H$ and the kinetic energy of washing water supplied to the lavatory bowl is multiplied by the suction of air from the water discharge channel, the force of the flushing water directed from the lavatory bowl to the water discharge channel increases, thereby achieving powerful discharge of the sewage or the like in the lavatory bowl. Since washing water is supplied to the lavatory bowl prior to the suction of air from the water discharge channel, the sewage and paper in the lavatory bowl is dashed with the washing water and, specifically, paper is broken to pieces in water, so that they are discharged easily to the water discharge channel.

Therefore, discharge of the sewage or the like in the lavatory bowl is satisfactorily achieved without increasing the amount of supply of the washing water from the rim water channel to the lavatory bowl.

Therefore, according to the above-described lavatory pan washing apparatus, higher discharge performance and higher water-saving effect are both achieved.

Various types of water supply means may be employed as long as they supply washing water to the lavatory bowl of the lavatory pan. In view of controllability, the water supply means which supplies washing water directly from a water pipe is preferable. The water discharge channel is a portion which continues to the downstream side of the water sealing portion of the lavatory pan. The water discharge channel may be integral with the lavatory pan or may be separate from the lavatory pan. Various types of air sucking means may be employed as long as they suck air from the water discharge channel. Various types of control means may be employed as long as they control the water supply means and the air sucking means.

In the lavatory pan washing apparatus in the present invention, the control means preferably activates the air sucking means 3 to 20 seconds, more preferably, 7 to 15 seconds after having activated the water supply means. According to the results of experiment conducted by the inventors, a sufficient amount of washing water is supplied to the lavatory bowl before activating the air sucking means, and hence the effects and advantages of the present invention are positively demonstrated in this configuration.

In the lavatory pan washing apparatus in the present invention, preferably, the water discharge channel is provided with a retaining portion for retaining the washing water and eliminating or reducing the communicating area, and the air sucking means sucks air from a portion between the water sealing portion and the retaining portion. In this configuration, the water discharge channel is blocked or is hardly communicated with the downstream by the existence of the retaining portion, so that the air sucking means can hardly suck air from the downstream of the retaining portion, and the air is not sucked from the downstream side in the optimal case. In other words, the air sucking means can suck air efficiently from a closed space existing between the water sealing portion and the retaining portion. Therefore, the siphon action is positively induced, and hence the effects and advantages of the present invention are reliably demonstrated. The configuration of the retaining portion may be an inner flange or the like which receives supply of washing water overflowed from the water sealing portion to reduce or eliminate the communicating area in addition to a U-shaped portion formed on the downstream side of the water sealing portion of the lavatory pan. The U-shaped portion does not have to eliminate the communicating area completely by the retaining portion.

In the lavatory pan washing apparatus according to the present invention, preferably, the air sucking means includes an ejector for generating a negative pressure by the washing water passed therethrough, and a tank for accumulating a negative pressure generated by the ejector by sucking air therein. The air inlet pipe communicates the tank with the water discharge channel and has a valve opened and closed by the control means. In this configuration, the negative pressure is accumulated in the tank, and the flexibility of timing to open the valve is increased, so that air is rapidly sucked from the water discharge channel as soon as the valve is opened. Accordingly, the effects and advantages of the present invention are achieved more remarkably.

In the lavatory pan washing apparatus according to the present invention, preferably, the lavatory pan is configured in such a manner that a whirling flow is formed in the lavatory bowl by the activation of the water supply means. In this configuration, the sewage and the paper are collected to the center in the lavatory bowl, and the paper is broken to pieces during whirling, so that the sewage and the paper are discharged smoothly to the water discharge channel. Therefore, the effects and advantages of the present invention are achieved more remarkably.

A lavatory pan washing method according to the present invention is a lavatory pan washing method including supplying washing water to a lavatory bowl of a lavatory pan and sucking air from a water discharge channel connected to a downstream side of a water sealing portion of the lavatory pan, characterized in that supply of the washing water to the water sealing portion via the lavatory bowl is started first, and the air is sucked from the water discharge channel after having raised the water level in the lavatory bowl.

The lavatory pan washing method of the present invention achieves both the higher discharging performance and the higher water-saving effect in the same manner as the lavatory pan washing apparatus in the present invention.

DETAILED DESCRIPTION

Figure 1:
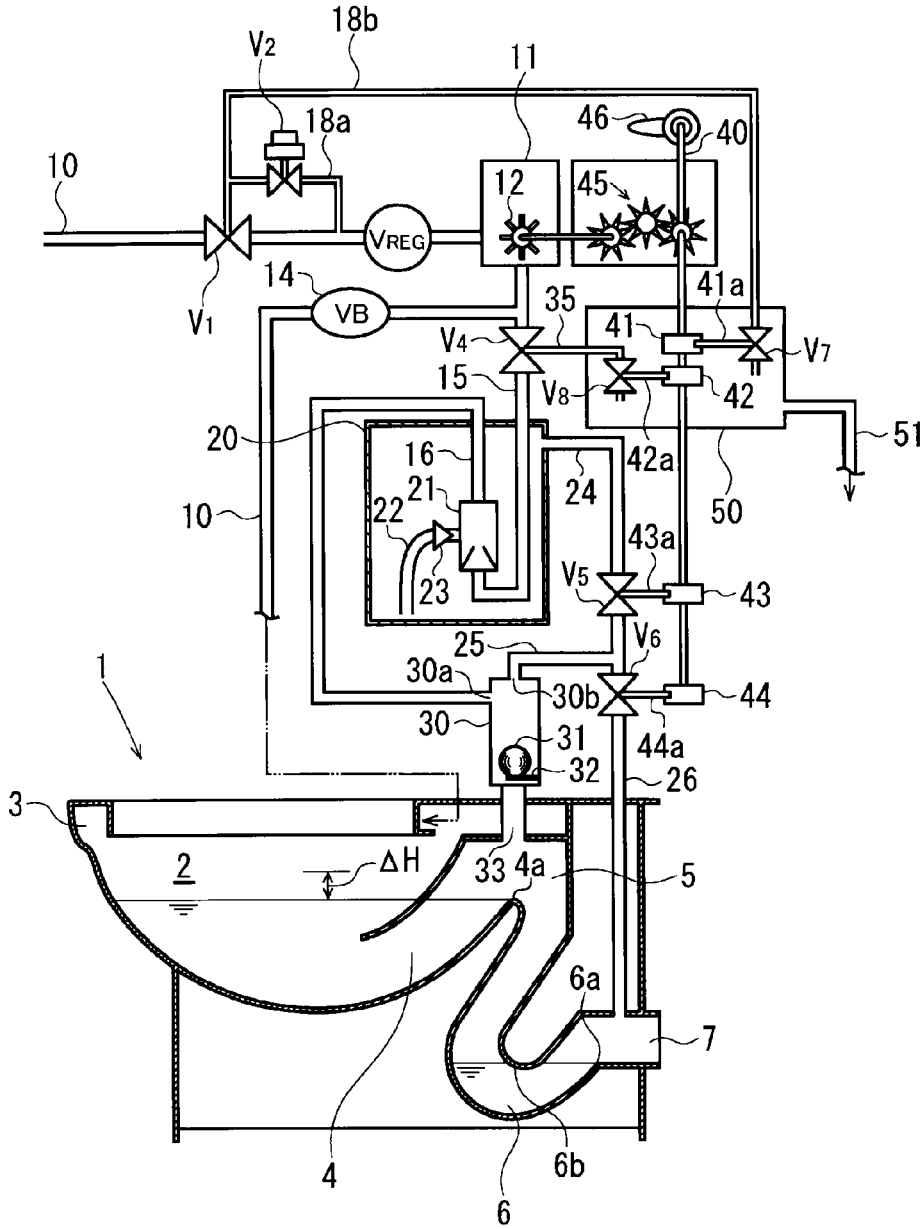
FIG. 1 is a pattern diagram of a lavatory pan washing apparatus according to an embodiment.

Referring now to the drawings, embodiments of the present invention will be described.

Figure 2:
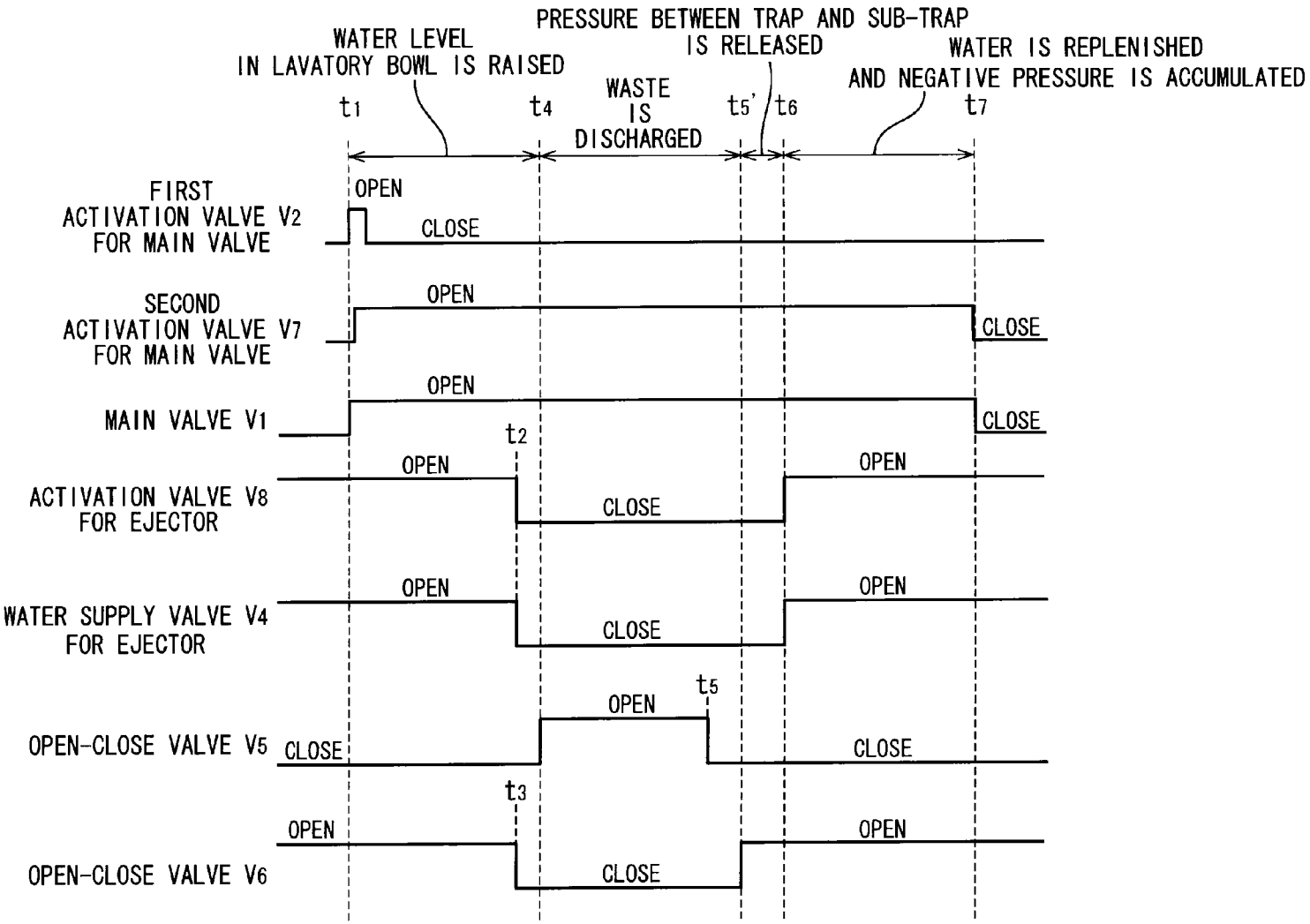
FIG. 2 is a timing chart for explaining operation of the lavatory pan washing apparatus in FIG. 1.
Figure 3:
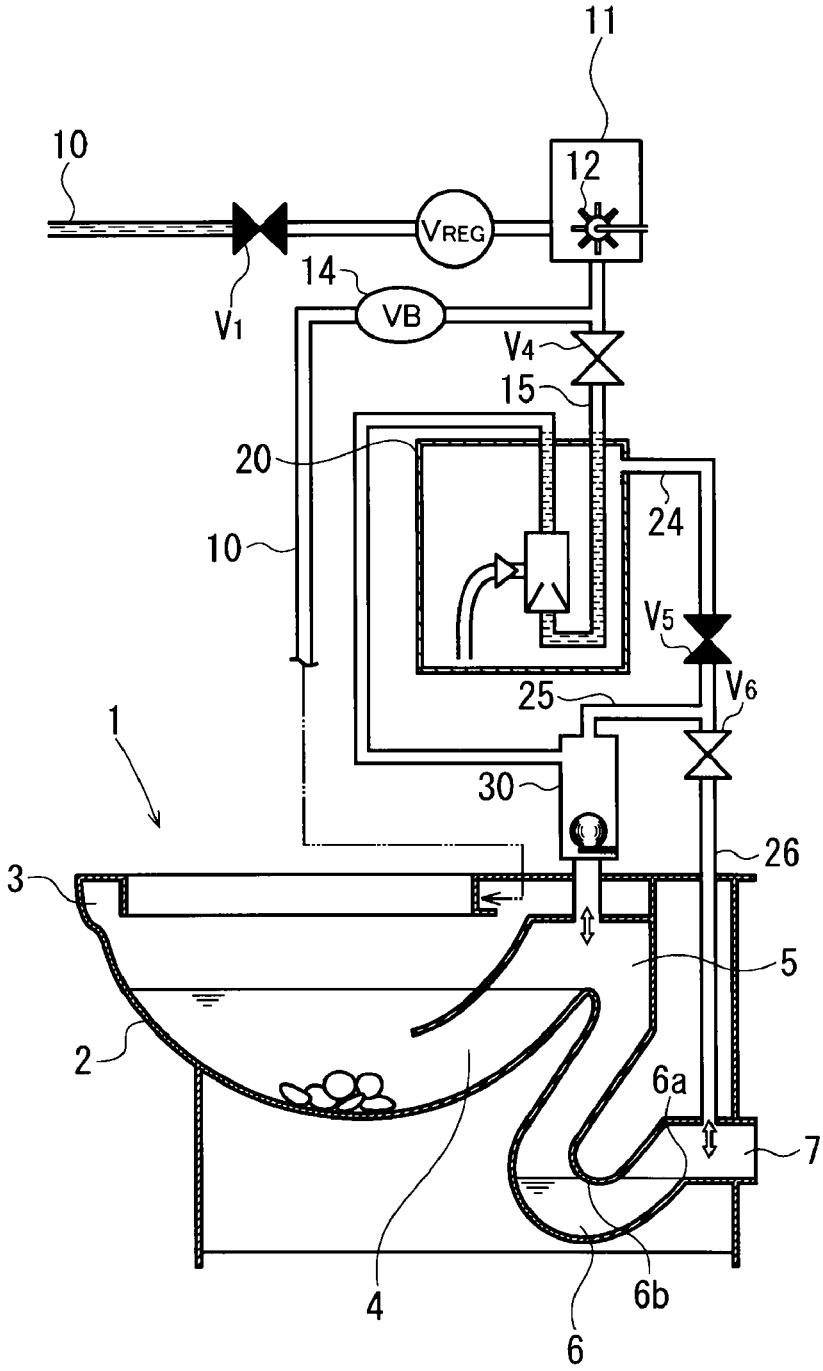
FIG. 3 is a pattern diagram for explaining operation of the lavatory pan washing apparatus in FIG. 1 when not washing.
Figure 4:
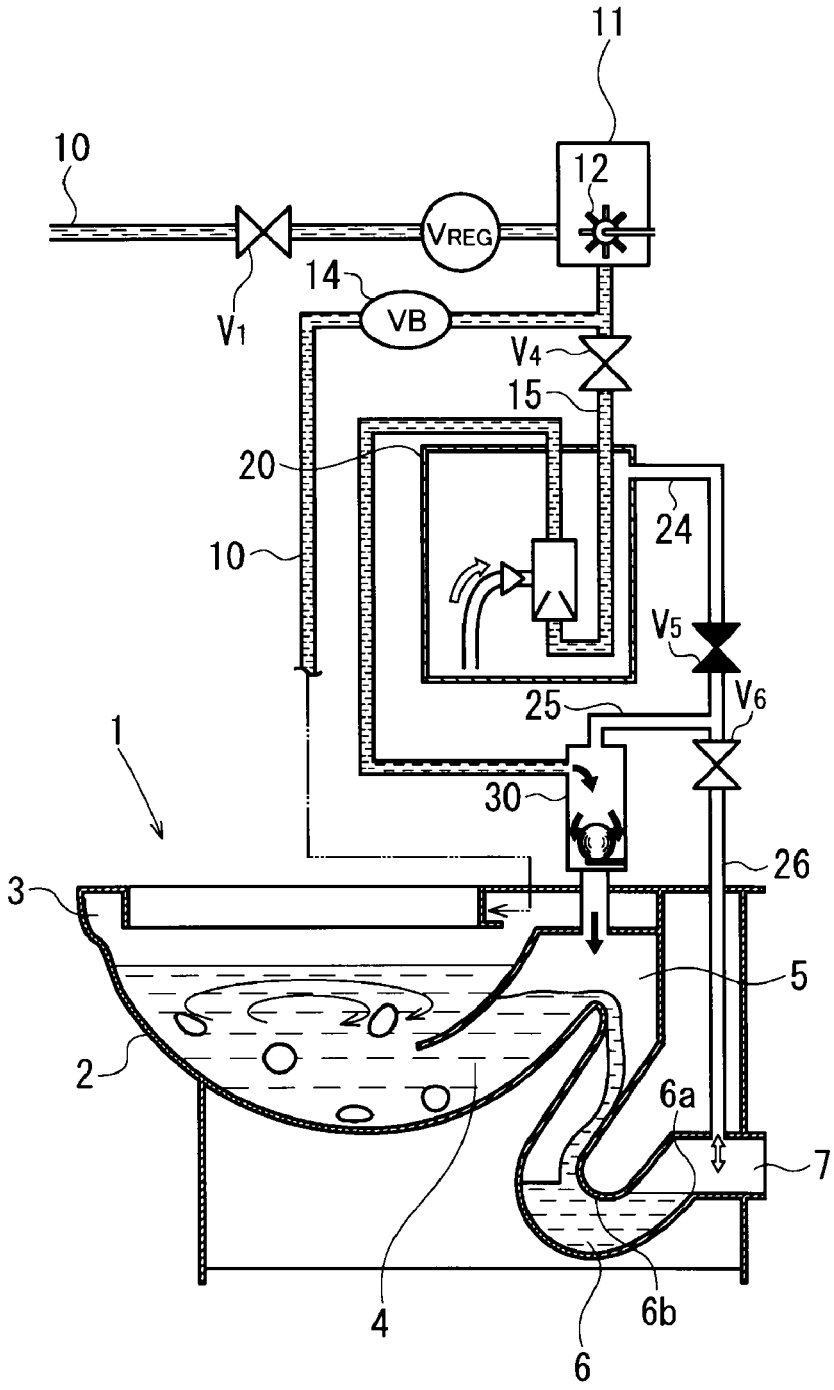
FIG. 4 is a pattern diagram for explaining operation of the lavatory pan washing apparatus in FIG. 1 in a process of rising water level in a lavatory bowl.
Figure 5:
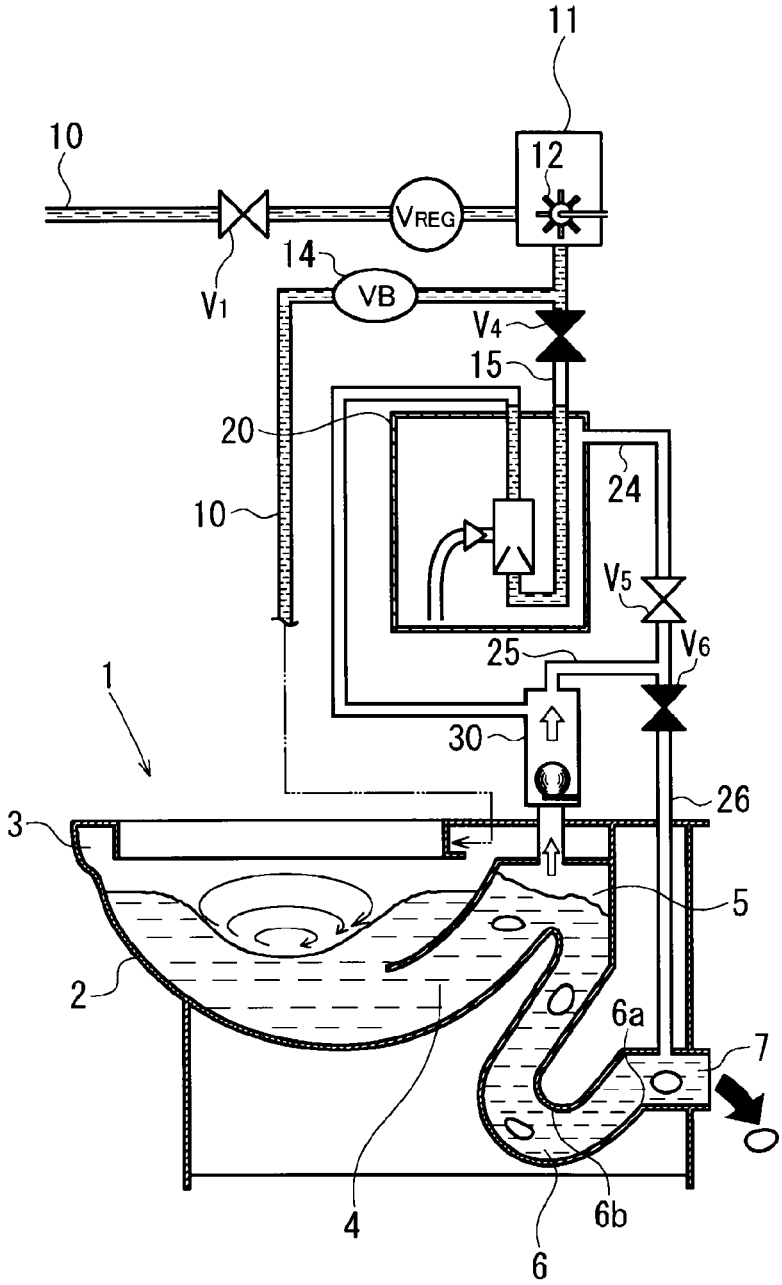
FIG. 5 is a pattern diagram for explaining the operation of the lavatory pan washing apparatus in FIG. 1 in a process of discharging waste.
Figure 6:
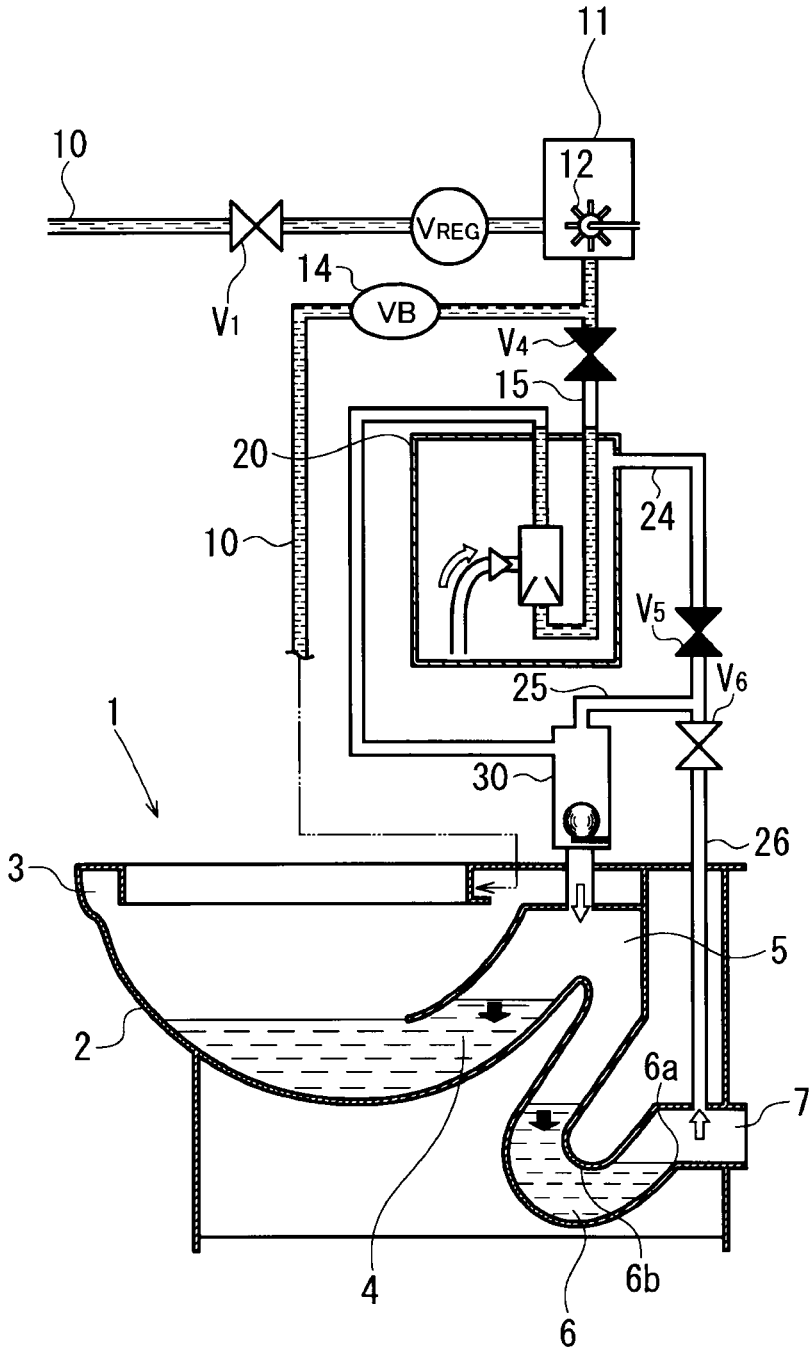
FIG. 6 is a pattern diagram for explaining the operation of the lavatory pan washing apparatus in FIG. 1 in the process of opening to the atmosphere a section between a water sealing portion and a retaining portion.
Figure 7:
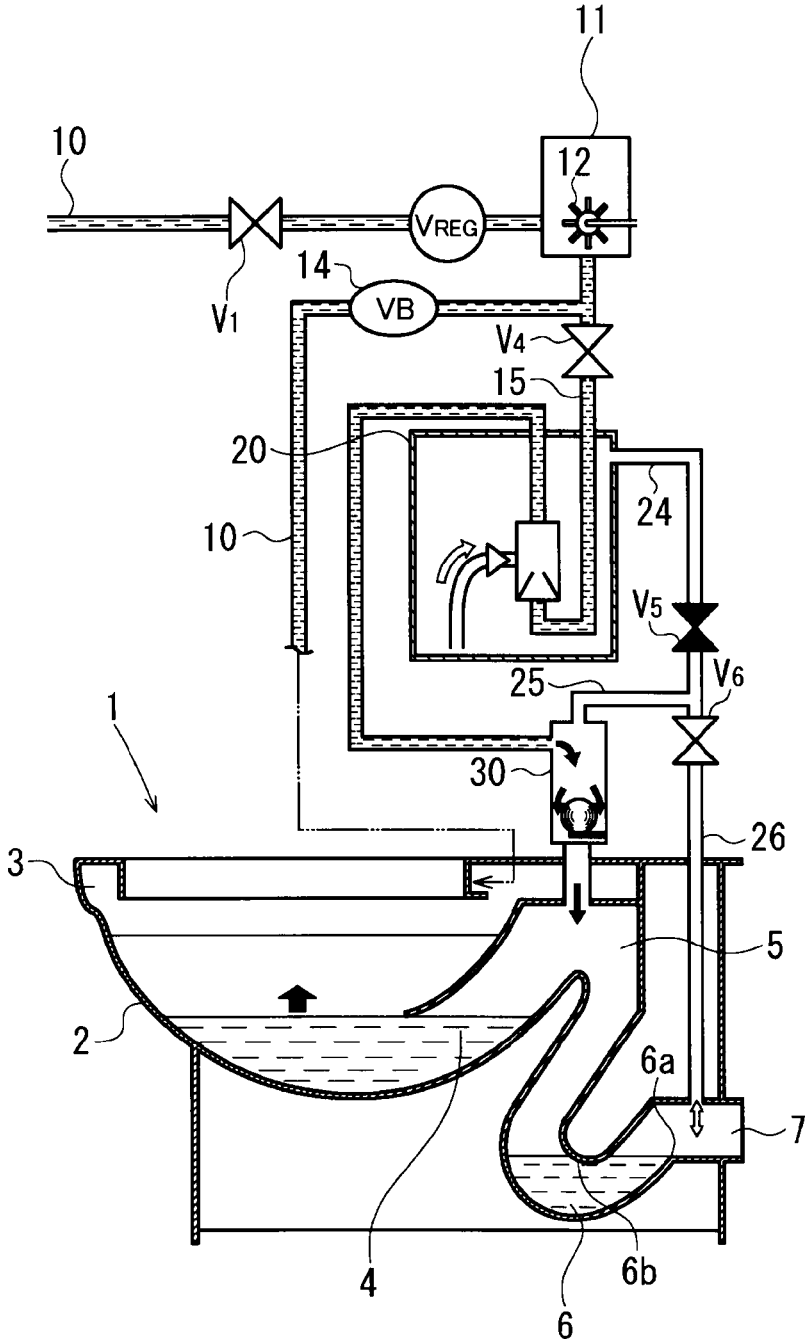
FIG. 7 is a pattern diagram for explaining the operation of the lavatory pan washing apparatus in FIG. 1 in a process of replenishing water and accumulating negative pressure.
Figure 8:
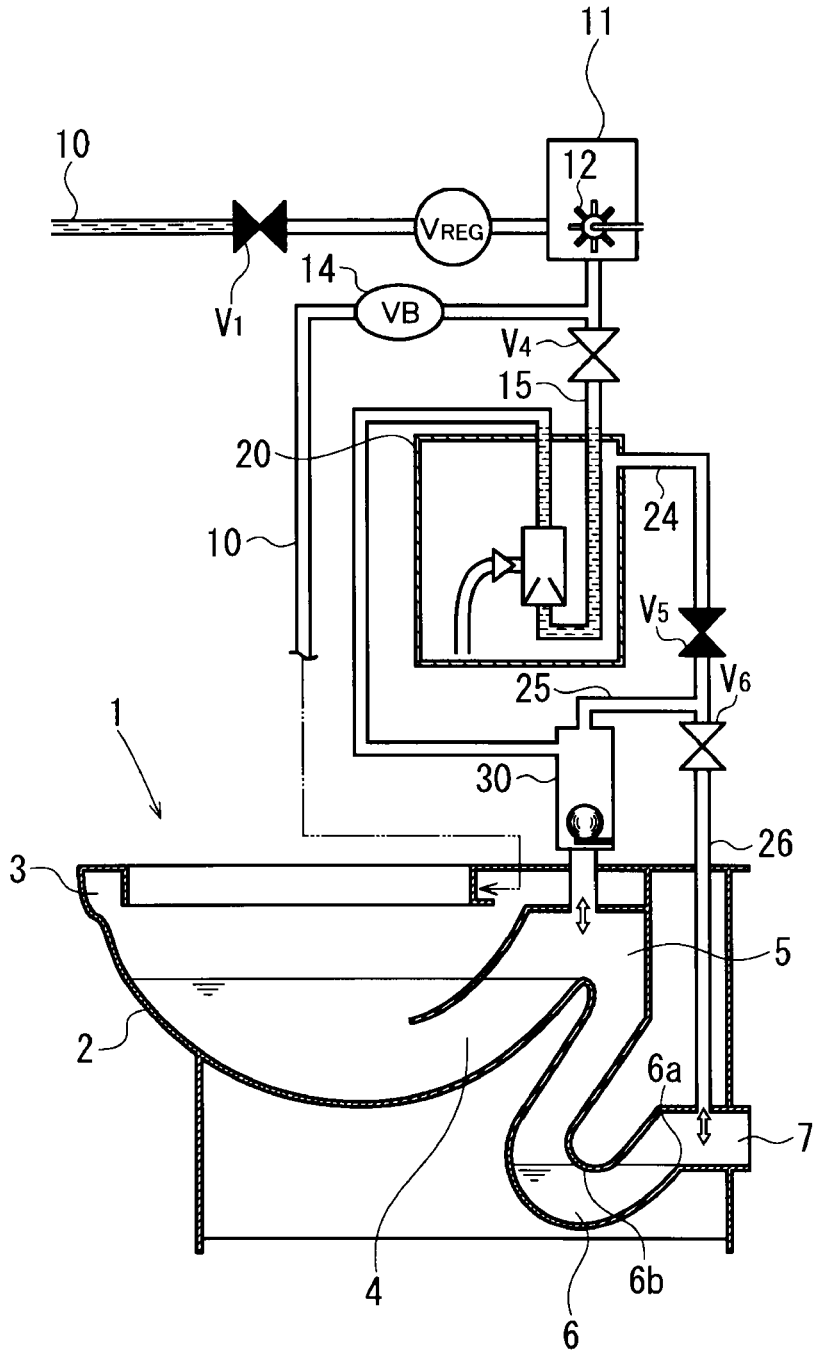
FIG. 8 is a pattern diagram for explaining the operation of lavatory pan washing apparatus in FIG. 1 in the waiting state.

FIG. 1 is a pattern diagram of a lavatory pan washing apparatus according to an embodiment, and FIG. 2 is a timing chart for explaining operation of the lavatory pan washing apparatus in FIG. 1. FIG. 3 to FIG. 8 are pattern diagrams for explaining operation of the lavatory pan washing apparatus in FIG. 1 when not washing, a process of rising water level in a lavatory bowl, a process of discharging waste, a process of opening to the atmosphere a section between a water sealing portion and a retaining portion, a process of replenishing water and accumulating negative pressure and a waiting state, respectively in sequence. Part of FIG. 1 is not shown in FIG. 3 to FIG. 8 for easiness of understanding.

A lavatory pan 1 formed of earthenware is provided with a rim 3 along an inner peripheral of the upper portion of a lavatory bowl 2. A water sealing portion 4 is composed of a lower portion of the lavatory bowl 2 and a rising conduit continuing thereto. The water sealing portion 4 communicates with a water discharge port 7 via a water discharge channel 5 and a retaining portion 6. The water discharge channel 5 is bent downward from a highest point 4*a* of the water sealing portion 4 and continues to the retaining portion 6. The water discharge port 7 is connected to a water discharge pipe.

The retaining portion 6 is composed of a U-shaped flow channel which extends under a lowest point 6*b* of a lower portion of a pipe wall of the water discharge channel 5 so as to embrace the same and then extends to a highest point 6*a* where water overflows. The height of the highest point 6*a* of the retaining portion 6 is slightly higher than the lowest point 6*b* and the lowest point 6*b* is submerged under sealing water in the retaining portion 6 when the lavatory pan is not in use.

However, the lowest point 6*b* may be slightly higher than the highest point 6*a*, and may be positioned slightly above the sealing water level in the retaining portion 6 when the lavatory pan is not in use. In this manner, even when the lowest point 6*b* is above the sealing water level, when the water level is raised because a negative pressure is applied to the water discharge channel 5 or water is flowed into the retaining portion 6, the lowest point 6*b* is submerged under the sealing water so that it is possible to seal a portion between the water discharge channel 5 and the water discharge port 7.

Water supply means includes, as described below, a water supply pipe 10, a main valve $V_1$ provided at the water supply pipe 10, a pressure regulating valve $V_{REG}$ provided at the water supply pipe 10 at the downstream of the main valve $V_1$, a vacuum breaker 14 provided at the water supply pipe 10 at the downstream of the main valve $V_1$ and the pressure regulating valve $V_{REG}$, and a first activation valve $V_2$ and a second activation valve $V_7$ for opening the main valve $V_1$.

The water supply pipe 10 is connected to the rim 3. The lavatory pan 1 employs a one-way water supply system in which water is supplied from the rear side of the lavatory bowl 2 only to the right side or the left side with respect to the rim 3. When water from the water supply pipe 10 is supplied toward the front from the rear side of the lavatory bowl 2 toward the rim 3 on the left side or the right side, a clockwise or counterclockwise whirl flow is formed in the lavatory bowl 2.

The water supply pipe 10 is provided with the main valve $V_1$, the pressure regulating valve $V_{REG}$, a water turbine unit 11 having a water turbine 12 and the vacuum breaker 14 in this order from the upstream side.

The main valve $V_1$ is a water-pressure-controlled valve, which is closed by being applied with a water supply pressure to a head side of the valve body and bringing the valve body to be seated on a valve seat and is opened by releasing water pressure on the head side in pipes 18*a*, 18*b* by the first activation valve $V_2$ or the second activation valve $V_7$.

The water discharge side of the first activation valve $V_2$ is connected to a portion between the main valve $V_1$ and the pressure regulating valve $_{VREG}$ via the pipe 18*a*. The water discharging side of the second activation valve $V_7$ communicates with the interior of a casing 50 described later. The first activation valve $V_2$ is a self-closing valve which is opened by being pressed and is closed when releasing the hand.

The air sucking means includes an ejector 21, a pipe 15 having a water supply valve $V_4$ for the ejector 21, an air tank 20 in which a negative pressure is accumulated, a pipe 22 having a check valve 23 for sucking air, an air inlet pipe (a pipe 24 and a pipe 25 for transmitting the negative pressure, and a float valve device 30) for communicating the air tank 20 and the water discharge channel 5, an open-close valve $V_5$ provided on the air inlet pipe, a pipe 16 connected to a discharge port of the ejector 21, and a pipe 26 provided with an open-close valve $V_6$.

A pipe 15 having the water supply valve $V_4$ is branched from the water supply pipe 10 at a position between the water turbine unit 11 and the vacuum breaker 14. The terminal end of the pipe 15 is connected to an inlet port of the ejector 21 arranged in the air tank 20 in which negative pressure is accumulated.

The proximal end of the pipe 22 having the check valve 23 for sucking air is connected to an air sucking port provided at a throat portion of the ejector 21. The distal end of the pipe 22 is arranged near the bottom surface of the air tank 20, and is adapted to be able to suck water, which may be accumulated in the air tank 20, through the pipe 22 when the ejector 21 is operated.

The check valve 23 allows air to flow from the pipe 22 for sucking air to the ejector 21, and prevents air from flowing in the opposite direction.

One end of the pipe 16 is connected to a discharge port of the ejector 21, and the other end of the pipe 16 is drawn out from the air tank 20 and is connected to a water port 30*a* at an upper portion of the float valve device 30. A lower portion of the float valve device 30 communicates with an upper portion of the water discharge channel 5 via a pipe 33. The configuration of the float valve device 30 will be described later.

The ejector 21 is installed in such a manner that water is running upward, and the pipe 15 extends downward from the water supply valve $V_4$ for the ejector 21 and communicates with an inlet port at the lower end of the ejector 21. The pipe 16 extends upward so as to communicate with a discharge port at the upper end of the ejector 21. The pipe 15, the ejector 21 and the pipe 16 constitute a trap formed substantially into a U-shape. The trap has a function to block water flow from the pipe 16 to the pipe 15.

The pipe 24 for transmitting a negative pressure is connected to the upper portion of the air tank 20, and the pipe 24 is connected to a negative pressure port 30*b* at the upper end of the float valve device 30 via the open-close valve $V_5$ and the pipe 25.

A float valve supporting member 32 is provided at a lower portion in the float valve device 30 and a vertically movable float valve 31 is arranged above the float valve supporting member 32. When the float valve 31 is placed on the supporting member 32, the ports 30*a*, 30*b* are in communication with the water discharge channel 5 via the pipe 33. When water flows into the interior of the float valve device 30 from the water discharge channel 5 via the pipe 33, the float valve 31 rises with the water, is seated to the port 30*b* from below to close the port 30*b*, so that sewage is prevented from flowing from the pipe 25 into the air tank 20.

The pipe 26 is branched at a midway of the pipe 25 and the terminal of the pipe 26 is connected to a portion on the downstream side of the retaining portion 6 (near the water discharge port 7). The open-close valve $V_6$ is provided on the pipe 26.

The water supply valve $V_4$ for the ejector 21 is a water-pressure-controlled valve, which is closed by being applied with a water supply pressure to a head side of the valve body and bringing the valve body to be seated on a valve seat and is opened by releasing water pressure on the head side by an activation valve $V_8$. The activation valve $V_8$ communicates with the head side of the water supply valve $V_4$ for the ejector 21 by a pipe 35.

Control means includes the water turbine 12, a gear train 45, a camshaft 40, cams 41, 42, 43, 44, cam rods 41*a*, 42*a*, 43*a*, 44*a*, and a manual lever 46 which are described later.

The second activation valve $V_7$ for controlling the main valve $V_1$, the activation valve $V_8$ for controlling the water supply valve $V_4$ for the ejector 21, and the open-close valves $V_5$, $V_6$ all employ a cam-driven system, and are activated by the cams 41, 42, 43, 44 and the cam rods 41*a*, 42*a*, 43*a*, 44*a* secured to the common camshaft 40. The camshaft 40 is connected to the water turbine 12 in the water turbine unit 11 via the gear train 45. The manual lever 46 is secured to the camshaft 40, and is adapted to be capable of being rotated manually.

The casing 50 is provided so as to embrace the activation valves $V_7$, $V_8$. Discharged water from the activation valves $V_7$, $V_8$ is discharged from the casing 50 to the rim 3 via a pipe 51.

Operation of the lavatory pan washing apparatus configured as described above will be described below.

[When not Washing (FIG. 3)]

In FIG. 2, when not washing before a time point $t_1$, the main valve $V_1$ and the first and second activation valves $V_2$, $V_7$ for the main valve $V_1$ are closed.

In this state, the activation valve $V_8$ for the ejector 21 is opened, and the water supply valve $V_4$ for the ejector 21 is also opened. However, since water is not running in the water supply pipe 10, the ejector 21 is in halt.

In this state, the open-close valve $V_5$ is closed and the interior of the air tank 20 is sealed. Therefore, a negative pressure accumulated in the interior of the air tank 20 in a process of replenishing water and accumulating a negative pressure, described later, is maintained as-is.

In this state, the open-close valve $V_6$ is opened. Since the open-close valve $V_6$ is opened, the water discharge channel 5 communicates with the water discharge pipe, and is normally maintained at the atmospheric pressure.

[Process of Raising Water Level in Lavatory Bowl (FIG. 4)]

After having used the lavatory, the lavatory user operates the first activation valve $V_2$ or the manual lever 46.

For the sake of convenience of description, a case in which the first activation valve $V_2$ is operated will be described here.

When the first activation valve $V_2$ is operated, the water pressure on the head side of the main valve $V_1$ is released to the downstream side of the main valve $V_1$ via the first activation valve $V_2$, and the main valve $V_1$ is opened. Accordingly, washing water is supplied from the water supply pipe 10 to the rim 3, and runs down while whirling along the inner surface of the lavatory bowl 2, so that a whirling flow is formed in the lavatory bowl 2. At this time, part of the water in the lavatory bowl 2 reaches and hence overflows from the highest point 4*a* of the water sealing portion 4. However, since the amount of water coming from the rim 3 is larger, the water level in the lavatory bowl 2 is raised. The whirling flow collects waste at the center of the lavatory bowl 2, and paper is broken to pieces, is well mixed in the water, and is dispersed in the water. Subsequently, when the discharging flow is formed by the siphon action, the waste and paper are smoothly discharged. The water overflowed from the highest point 4*a* of the water sealing portion 4 is held up in the retaining portion 6 and the water level on the side of the water discharge channel 5 is raised. Even when the water level in the retaining portion 6 is lowered by dryness or the like, the water level in the retaining portion 6 is raised by the overflowed water, and the communication between the water discharge channel 5 and the water discharge port 7 is blocked. Accordingly, the discharging flow due to the siphon action, described later, is formed easily.

When washing water flows in the water supply pipe 10, the water wheel 12 in the water wheel unit 11 rotates, and the camshaft 40 rotates at a reduced speed, which is lower than the rotation of the water wheel 12 via the gear train 45.

The cams 42, 43, 44 rotate in association with the rotation of the camshaft 40, and the valves $V_8$, $V_5$, $V_6$ open at predetermined timings.

Referring now to FIG. 2, the timings to close and open the valves will be described.

When the rotation of the camshaft 40 starts at the timing of $t_1$, the second activation valve $V_7$ for the main valve $V_1$ immediately opens. Therefore, after the hand is released from the first activation valve $V_2$ and hence the first activation valve $V_2$ is closed, the water pressure is not applied to the head side of the main valve $V_1$ and hence the main valve $V_1$ is kept open. The main valve $V_1$ is kept open until the second activation valve $V_7$ is closed as described later.

After the main valve $V_1$ is opened, the water level in the lavatory bowl 2 is raised and the bowl surface is washed for a predetermined time, and the whirling flow is formed as described above.

Since the activation valve $V_8$ for the ejector 21 is kept open and the water supply valve $V_4$ for the ejector 21 is also kept open at this moment, water flows to the ejector 21 as well when water flows into the water supply pipe 10 and a negative pressure is generated, so that air in the air tank 20 is sucked by the negative pressure and the negative pressure is accumulated in the air tank 20. Water discharged from the ejector 21 is discharged to the water discharge channel 5 via the pipe 16 and the float valve device 30. The water discharged from the ejector 21 at this time washes the interior of the float valve device 30. The water discharged from the ejector 21 is held up in the retaining portion 6 through the water discharge channel 5, whereby the water level in the retaining portion 6 on the side of the water discharge channel 5 is raised.

At a time point $t_2$ after having elapsed a predetermined time, the activation valve $V_8$ for the ejector 21 is closed, and the water supply valve $V_4$ for the ejector 21 is closed. Accordingly, all water passing through the water supply pipe 10 is supplied to the lavatory bowl 2.

At the same time point as $t_2$ or at a time point $t_3$ close thereto, the open-close valve $V_6$ is closed, the communication between the water discharge channel 5 and the water discharge port 7 via the pipes 25, 26 is blocked, so that the water discharge channel 5 forms a closed space therein.

[Process of Discharging Waste (FIG. 5)]

At a time point $t_4$, the open-close valve $V_5$ is opened. Accordingly, the negative pressure in the air tank 20 is transmitted to the water discharge channel 5 via the pipes 24, 25, the float valve device 30 and the pipe 33, and air in the water discharge channel 5 is sucked. At this time, the water level in the lavatory bowl 2 is sufficiently high as indicated by $\Delta H$ in FIG. 1, and the head difference $\Delta H$ with respect to the highest portion 4*a* of the water sealing portion 4 is sufficiently large. Therefore, the sewage in the lavatory bowl 2 is flushed out from the water sealing portion 4 to the water discharge channel 5 by an urging force including a potential energy generated by the head difference $\Delta H$ and the kinetic energy of the washing water supplied from the rim 3 to the lavatory bowl 2 multiplied by the negative pressure in the water discharge channel 5, and a discharge flow generated by the powerful siphon action is formed in the water sealing portion 4 and the water discharge channel 5.

As described above, in this process, since it is not necessary to supply water to the ejector 21 for accumulating the negative pressure, water passing through the water supply pipe 10 is entirely supplied to the lavatory bowl 2. Therefore, the water level in the lavatory bowl 2 is sufficiently high, and hence water flow of the washing water supplied to the lavatory bowl 2 is sufficiently powerful, whereby the discharge flow is generated by the powerful siphon action. Since the sufficient negative pressure is accumulated in the air tank 20 in advance in the process of raising water level in the lavatory bowl 2, and the negative pressure is transmitted to the water discharge channel 5 in this process, the pressure in the water discharge channel 5 is instantly lowered, and hence the siphon discharge flow is generated in the early stage.

When the sewage in the water discharge channel 5 is sucked into the float valve device 30, the float valve 31 rises with buoyancy, and a port 30*b* is closed. Accordingly, the sewage in the water discharge channel 5 is prevented from flowing in the opposite direction into the pipe 25 or the air tank 20. The inner surface of the float valve device 30 contaminated by the sewage is washed by water discharged from the ejector 21 when the ejector 21 is in operation as described above.

At a time point $t_5$ at the terminal of the process of discharging waste, the open-close valve $V_5$ is closed, and transmission of the negative pressure from the air tank 20 is stopped.

[Process of Opening to the Atmosphere a Section Between Water Sealing Portion and Retaining Portion (FIG. 6)]

At a time point $t_5'$, the open-close valve $V_6$ is opened, and the portion between the water sealing portion 4 and the retaining portion 6 communicates with the water discharge port 7, so that the portion between the water sealing portion 4 and the retaining portion 6 is returned to the atmospheric pressure. Accordingly, the replenishment of water to the lavatory bowl 2, the water sealing portion 4 and the retaining portion 6 is stably carried out in the process of replenishing water and accumulating negative pressure described later.

[Processes of Replenishing Water and Accumulating Negative Pressure (FIG. 7)]

Subsequently, at a time point $t_6$, the activation valve $V_8$ for the ejector 21 is opened, and hence the water supply valve $V_4$ for the ejector 21 is also opened. The open-close valve $V_6$ is also opened. At the time point $t_6$, the sewage in the lavatory bowl 2 is almost entirely discharged, and the sewage mixed with air is flowing with, so-called gurgling sound toward the water discharge channel 5. At this time point, the open-close valve $V_5$ is closed, and hence the atmospheric air is prevented from flowing into the air tank 20, so that useless consumption of the negative pressure in the air tank 20 is avoided.

By opening the open-close valve $V_6$ at the time point of $t_6$, the negative pressure in the water discharge channel 5 is released, and hence the water discharge from the lavatory bowl 2 is also stopped. At this time point, water supply to the rim 3 via the water supply pipe 10 is still continuing. Therefore, water is held up gradually in the lavatory bowl 2, and the replenishment of water is achieved. The water level in the lavatory bowl 2 is raised to the same level as the highest point 4*a* of the water sealing portion 4.

By opening the water supply valve $V_4$ for the ejector 21 at the time point $t_6$, the ejector 21 is activated, and the negative pressure is accumulated again in the air tank 20.

[Waiting State (FIG. 8)]

At the time point of $t_7$, the second activation valve $V_7$ for the main valve $V_1$ is closed, and in association therewith, the main valve $V_1$ is closed, and hence running water in the water supply pipe 10 is stopped. Accordingly, the lavatory pan washing apparatus is brought into the waiting state.

Running water to the ejector 21 is also stopped in association with the stop of running water in the water supply pipe 10. Since the check valve 23 is provided between the throat portion of the ejector 21 and the air tank 20, the atmospheric air is prevented from flowing from the stopped ejector 21 into the air tank 20, and the negative pressure accumulated in the air tank 20 is maintained as-is.

At the time point $t_7$ as well, the water supply valve $V_4$ for the ejector 21 and the open-close valve $V_6$ are kept open, and this state continues until the next lavatory pan washing (the operation of the first activation valve $V_2$).

<Operation with Manual Handle>

The description of the operation described above corresponds to the case in which the first activation valve $V_2$ for the main valve $V_1$ is operated. However, the similar series of actions are carried out when the manual lever 46 is operated. In this case, the first activation valve $V_2$ for the main valve $V_1$ is kept closed. The main valve $V_1$ is opened and closed in association with the opening and closing of the second activation valve $V_7$. The sequences of action of other valves $V_4$ to $V_6$, $V_8$ are the same as that in FIG. 2.

<Time Difference Between $t_1$ and $t_4$>

The time difference between the time point $t_1$ at which the main valve $V_1$ is opened and water supply to the rim 3 is started and the time point $t_4$ at which sucking of air in the water discharge channel 5 is started is preferably from 3 to 20 seconds, more preferably, approximately from 7 to 15 seconds. In this manner, the intervals among the time points $t_1$ to $t_4$ may be set on the basis of the amount of water supply to the rim 3 instead of the time difference.

This embodiment in the present invention is an illustrative only, and the invention is not limited to the above-described embodiment. For example, all or part of the valves may be opened and closed by electric control.

The source of the negative pressure of the air sucking means that sucks air from the water discharge channel 5 may be those other than the ejector 21, such as an electric vacuum pump.

Although the embodiment shown above employs the siphon system washing, a siphon jet system washing may also be applicable.

It is also possible to differentiate the process of washing between stool and urine.

The invention claimed is:

1. A lavatory pan washing apparatus comprising:

water supply means that supplies washing water into a rim in a one-way supply manner so that a whirling flow is formed in a lavatory bowl of a lavatory pan, the rim being provided along an upper inner periphery of the lavatory bowl;

an air inlet pipe connected to a water discharge channel continuing to a downstream side of a water sealing portion of the lavatory pan;

air sucking means that sucks air through the air inlet pipe from the water discharge channel; and control means that is configured to activate the water supply means at a time of washing of the lavatory pan so that the washing water is supplied through the lavatory bowl into the water sealing portion, the control means being further configured to start activation of the air sucking means after a water level in the lavatory bowl has risen so that air is sucked through the air inlet pipe from the water discharge channel, the control means being further configured to deactivate the water supply means after air has flowed through the air inlet pipe into the water discharge channel.

2. The lavatory pan washing apparatus according to claim 1, wherein the control means is configured to activate the air sucking means 3 to 20 seconds after having activated the water supply means.

3. The lavatory pan washing apparatus according to claim 2, wherein the air inlet pipe is provided with a back-flow prevention device which prevents back-flow of the sewage.

4. The lavatory pan washing apparatus according to claim 2, wherein the air sucking means includes:

an ejector configured to generate a negative pressure by the washing water passed therethrough; and a tank configured to accumulate a negative pressure generated by the ejector by sucking air therein, wherein the air inlet pipe communicates the tank with the water discharge channel and has a valve opened and closed by the control means.

5. The lavatory pan washing apparatus according to claim 1, wherein the water discharge channel is provided with a retaining portion to retain the washing water and eliminating or reducing a communicating area, and the air sucking means sucks air from a portion between the water sealing portion and the retaining portion.

6. The lavatory pan washing apparatus according to claim 5, wherein the air inlet pipe is provided with a back-flow prevention device which prevents back-flow of the sewage.

7. The lavatory pan washing apparatus according to claim 5, wherein the air sucking means includes:

an ejector configured to generate a negative pressure by the washing water passed therethrough; and a tank configured to accumulate a negative pressure generated by the ejector by sucking air therein, wherein the air inlet pipe communicates the tank with the water discharge channel and has a valve opened and closed by the control means.

8. The lavatory pan washing apparatus according to claim 1, wherein the air sucking means includes:

an ejector configured to generate a negative pressure by the washing water passed therethrough; and a tank configured to accumulate a negative pressure generated by the ejector by sucking air therein, wherein the air inlet pipe communicates the tank with the water discharge channel and has a valve opened and closed by the control means.

9. The lavatory pan washing apparatus according to claim 1, wherein the air inlet pipe is provided with a back-flow prevention device which prevents back-flow of the sewage.

10. A lavatory pan washing method comprising:

supplying washing water to a lavatory bowl of a lavatory pan; and sucking air from a water discharge channel connected to a downstream side of a water sealing portion of the lavatory pan, wherein supply of the washing water to the water sealing portion via the lavatory bowl is started first, and the air is sucked from the water discharge channel after having raised the water level in the lavatory bowl.

* * * * *